US009702660B1

(12) United States Patent
Dutton

(10) Patent No.: US 9,702,660 B1
(45) Date of Patent: Jul. 11, 2017

(54) VOLLEY GUN

(71) Applicant: U.S. Army Research Laboratory ATTN: RDRL-LOC-I, Adelphi, MD (US)

(72) Inventor: Todd A. Dutton, Odenton, MD (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 0 days.

(21) Appl. No.: 15/051,702

(22) Filed: Feb. 24, 2016

(51) Int. Cl.
*F41F 1/08* (2006.01)
*F41A 21/06* (2006.01)

(52) U.S. Cl.
CPC ..... *F41F 1/08* (2013.01); *F41A 21/06* (2013.01)

(58) Field of Classification Search
CPC ..... F41F 1/08; F41F 1/085; F41F 1/10; F41A 21/06; F41A 21/08; F42B 5/035
USPC ..... 89/1.41
See application file for complete search history.

(56) References Cited

U.S. PATENT DOCUMENTS 45,623 A * 12/1864 Natcher ..... F41A 9/35 89/1.1
627,966 A * 7/1899 Behr ..... F41C 3/14 42/59
632,098 A * 8/1899 Capps ..... F41A 7/08 89/1.41
634,826 A * 10/1899 Masini ..... F42B 5/03 102/438
943,819 A * 12/1909 Bose ..... F41C 3/14 42/59
2,935,915 A * 5/1960 Janson ..... F41A 5/28 89/126
2,972,286 A * 2/1961 Marquardt ..... F41F 1/08 89/126
3,720,133 A * 3/1973 Jampy ..... F41A 9/35 42/50
5,282,455 A * 2/1994 Adamson ..... F41A 9/26 124/48
6,742,434 B1 * 6/2004 Dillon ..... F41A 3/26 42/16

* cited by examiner

*Primary Examiner* — Joshua Freeman
(74) *Attorney, Agent, or Firm* — Alan I. Kalb

(57) ABSTRACT

A gun having at least two barrels wherein each barrel is adapted to receive at least one projectile. The barrels are attached to a gun body having a gun chamber adapted to receive a propelling charge. An interface between the gun chamber and the barrels selectively connects the gun chamber with one or more of the barrels to fire a variable number of projectiles at variable velocities.

5 Claims, 5 Drawing Sheets

VOLLEY GUN

GOVERNMENT INTEREST

The invention described herein may be manufactured, used, and licensed by or for the United States Government.

BACKGROUND OF THE INVENTION

I. Field of the Invention

The present invention relates generally to firearms and, more particularly, to a volley gun.

II. Description of Related Art

There are many previously known volley guns, i.e. guns capable of firing two or more projectiles simultaneously. These previously known volley guns typically include a plurality of barrels which are aggregated together. Each barrel is loaded individually with a projectile and propellant so that each gun barrel acts independently, although in some previously known designs a common firing method was employed to ignite the individual propellant charges for the individual barrels simultaneously or substantially simultaneously.

These previously known volley guns suffered from a number of different disadvantages. In particular, the previously known volley guns suffered from a large variance in timing of the fire since it is difficult to ignite the propellant charge for each barrel independently and simultaneously. Furthermore, even small time delays in the ignition of the propellant for the different barrels result in torque loads applied to the gun during firing. These torque loads in turn result in inaccurate firing of the projectiles from the various barrels.

SUMMARY OF THE PRESENT INVENTION

The present invention provides a volley gun which overcomes the above mentioned disadvantages of the previously known volley guns.

In brief, the volley gun of the present invention includes a gun having a gun body and at least two and preferably more gun barrels. Each gun barrel is adapted to receive at least one projectile to be discharged from the volley gun.

A gun chamber is formed in the gun body which is adapted to receive a propelling charge. This gun barrel, in turn, is fluidly connected through an interface with one or more of the barrels. Preferably, the interface is variable to permit a selected, but variable, number of gun barrels to be in fluid communication with the gun chamber.

Unlike the previously known volley guns, a single propelling charge is ignited within the gun chamber in order to propel the projectiles out through their respective barrels.

A primary advantage of the present invention is that, by adjusting the number of barrels fluidly connected to a gun chamber, the discharge velocity of the projectile may be varied. For example, a high velocity projectile discharge may be achieved by limiting the fluid connection of the gun chamber to a single barrel. Conversely, by fluidly connecting the gun chamber to two or more barrels, and assuming the same propelling charge is contained within the gun chamber, the muzzle velocity of the projectile will be lowered.

Different types of interfaces may be used to fluidly connect the gun chamber to the selected gun barrels. For example, the interface could include an orifice plate, valves, plugs, vents, as well as other mechanisms.

BRIEF DESCRIPTION OF THE DRAWING

A better understanding of the present invention will be had upon reference to the following detailed description when read in conjunction with the accompanying drawing, wherein like reference characters refer to like parts throughout the several views, and in which.

DETAILED DESCRIPTION OF PREFERRED EMBODIMENTS OF THE PRESENT INVENTION

Figure 1:
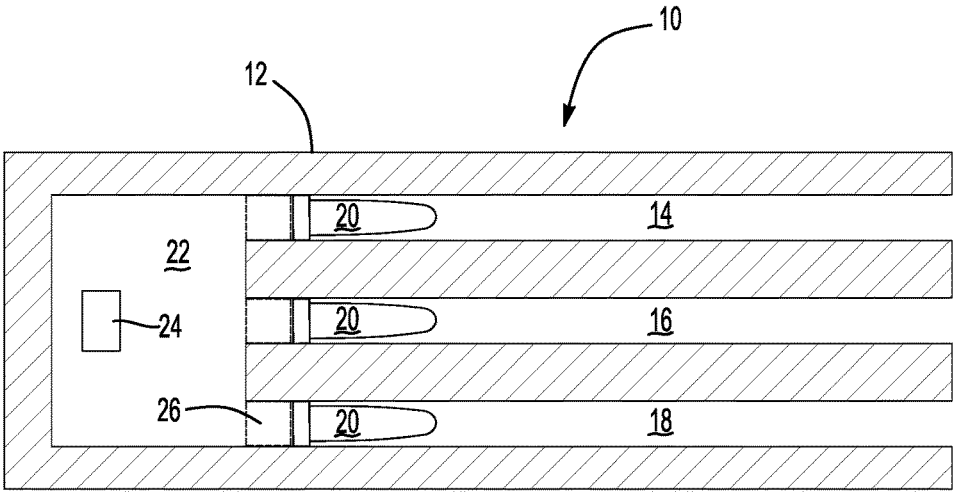
FIG. 1 is a diagrammatic view illustrating a volley gun according to the present invention in which three separate projectiles may be fired simultaneously.
Figure 2:
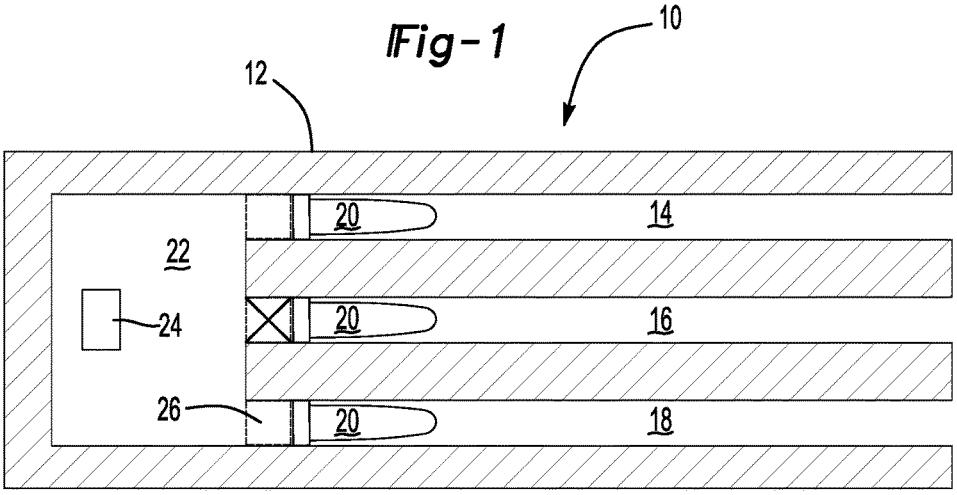
FIG. 2 is a view similar to FIG. 1, but illustrating the same volley gun in which only two projectiles are fired simultaneously.
Figure 3:
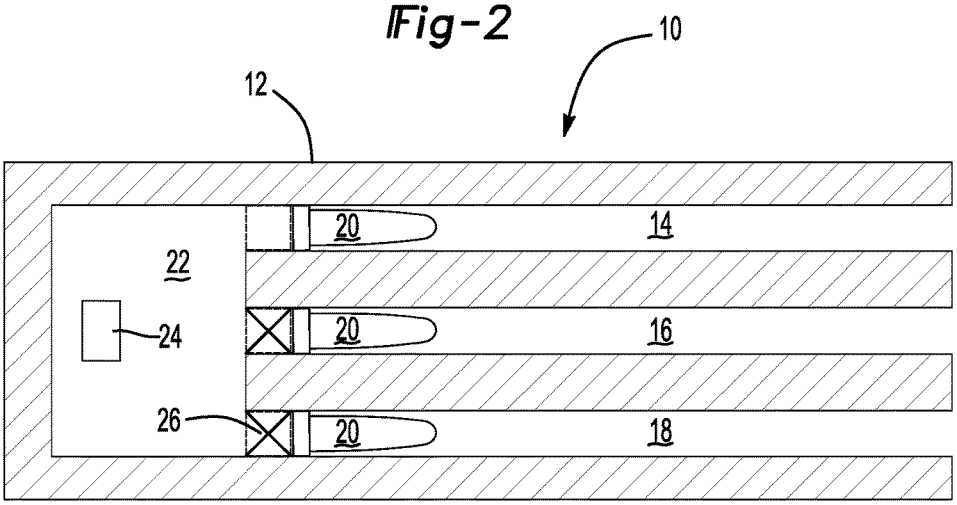
FIG. 3 is a view similar to FIGS. 1 and 2, but illustrating the volley gun in which only a single projectile is fired.

With reference first to FIGS. 1-3, a gun is shown diagrammatically. The gun includes a gun body 12 having a plurality of barrels 14, 16, and 18. Although the gun 10 shown in FIGS. 1-3 contains three barrels 14-18, a different number of barrels 14-18 may be used as long as there are at least two barrels.

Each barrel 14-18 is adapted to receive one projectile 20, such as a bullet. When the gun 10 is fired, the projectile 20 is discharged through its respective barrel 14-18.

A gun chamber 22 is formed in the gun body 12. The gun chamber 22 receives a propelling charge 24, such as a combustible charge which may be ignited in any conventional fashion. Other types of propelling charges may be used to pressurize the gun chamber 22. For example, any type of noncombustible gas pressurization may alternatively be used. Furthermore, the expanding gases resulting from the propelling charge 24 flow through an interface device 26 to one or more of the barrels 14-18.

For example, in FIG. 1, the interface device 26 fluidly connects the gun chamber 22 to all three barrels 14, 16, and 18. Consequently, upon pressurization of the gun chamber, the expanding gases are coupled to all three barrels 14, 16, and 18 to discharge their respective projectiles 20 out through their respective barrels 14-18. However, since the propelling charge 24 is used to simultaneously propel all three bullets 20 through all three barrels 14-18, the velocity of the projectiles 20 is relatively low. Indeed, by increasing the number of barrels 14-18 and/or decreasing the propelling charge 24, the discharge speed of the projectiles 20 through their respective barrels 14-18 may be sufficiently low so as to be nonlethal.

With reference now to FIG. 2, the gun 10 is there shown in the same configuration as shown in FIG. 1, except that the interface device 26 has blocked or fluidly disconnected the barrel 16 from the gun chamber 22. That blocking or fluid disconnection is indicated by the letter X in the interface device.

With the barrel 16 effectively removed from the gun chamber 22, upon ignition of the combustible charge 24, the expanding gases from the ignition of the combustible charge 24 simultaneously expand through only two barrels 14 and 18. As such, since the expanding gases from the gun chamber 22 are restricted to only two barrels, the exit or muzzle velocity of the projectiles 20 from their respective barrels 14 and 18 is much higher than as shown in FIG. 1.

Similarly, with reference now to FIG. 3, the interface device 26 has fluidly disconnected the barrels 16 and 18 from the gun chamber 22. Consequently, upon initiation of the propelling charge 24, all of the expanding gases from ignition of the charge 24 must pass through the barrel 14. In doing so, the gun 10 fires only a single projectile 20 but at a much higher velocity than the guns shown in FIGS. 1 and 2.

The design of the interface 26 which selectively fluidly connects the gun chamber 22 to one or more of the barrels 14-18 may take many different forms. For example, the interface device could be an orifice plate, a valve, plugs, vents, or various other mechanisms to selectively direct the expanding gases from the gun chamber 22 into the selected barrels 14-16. However, in each case, since only a single combustible charge 24 is used to propel all the projectiles 20 upon firing of the gun, all of the projectiles 20 that are selected are fired simultaneously.

Figure 4:
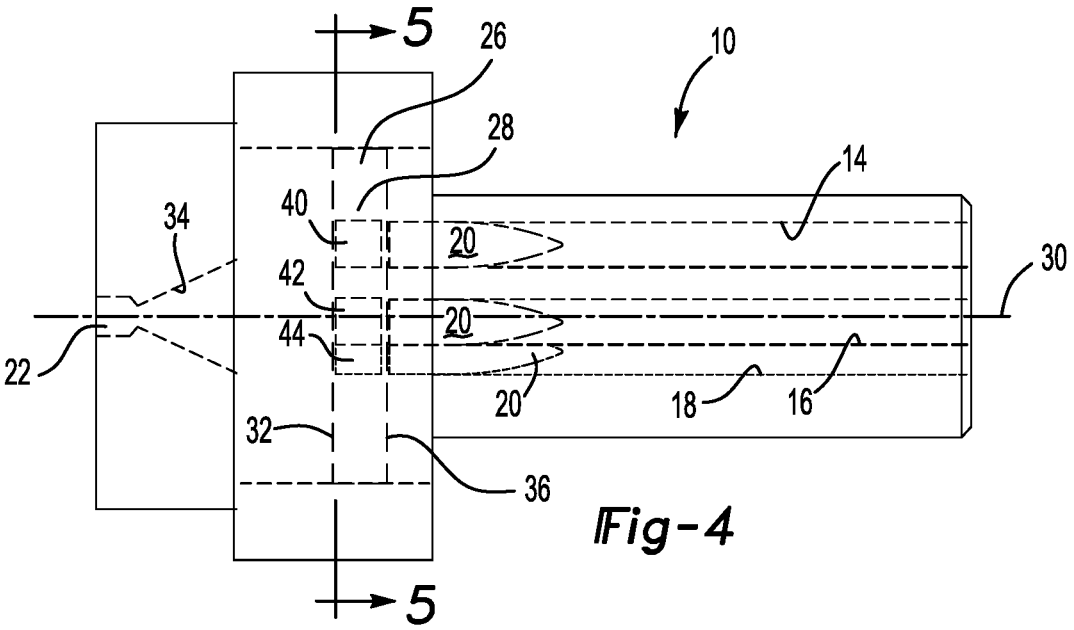
FIG. 4 is a longitudinal diagrammatic view illustrating a volley gun with an indexing plate to control the selection of the fired projectiles.
Figure 5:
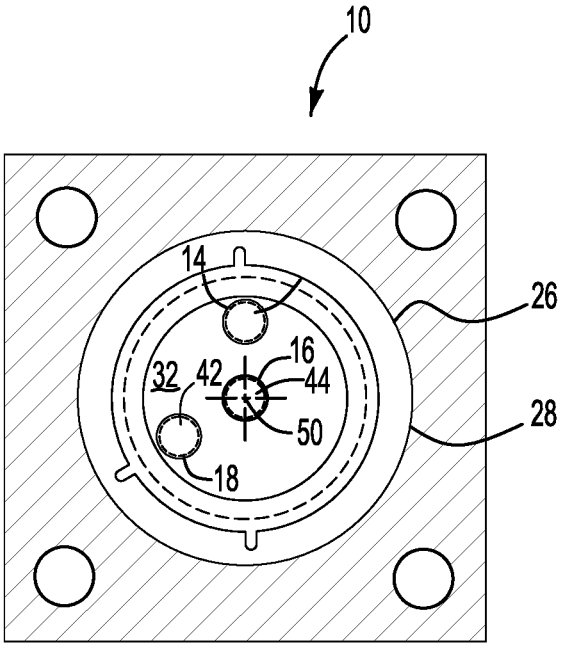
FIG. 5 is a view taken substantially along line 5-5 in FIG. 4.

For example, with reference to FIGS. 4 and 5, the interface device 26 is illustrated as an orifice plate 28 which may be rotatably indexed around its axis 30. A rear side 32 of the orifice plate 28 is fluidly connected to the gun chamber 22 by a conical fluid passageway 34.

As before, the gun 10 includes three gun barrels 14, 16, and 18, each of which is adapted to receive one projectile 20. These projectiles 20 abut against a front surface 36 of the orifice plate 28.

With reference now to FIGS. 4 and 5, the gun barrel 16 is aligned with the rotational axis 30 of the orifice plate 28. The other two barrels 14 and 18 are equidistantly spaced radially outwardly from the axis 30 of the orifice plate 28 and these barrels 14 and 18 are also circumferentially spaced from each other. Thus, with the orifice plate 28 in its first rotational indexing position illustrated in FIG. 5, a throughbore 40 in the orifice plate 28 registers or aligns with the first barrel 14 and fluidly connects the first barrel 14 with the gun chamber 22 through the orifice throughbore 40. Simultaneously, a throughbore 42 in the orifice plate 28 fluidly connects the gun barrel 18 with the gun chamber 22 while a throughbore 44 in the orifice plate 28 fluidly connects the gun barrel 16 with the gun chamber 22.

Consequently, with the orifice plate 28 in the rotational indexing position shown in FIG. 5, the gun chamber 22 is fluidly connected to all three gun barrels 14-18. As such, upon initiation of the propelling charge 24 in the gun chamber 22, all three projectiles 20 will be simultaneously fired out through their respective barrels 14-18 at a relatively low velocity.

Figure 6:
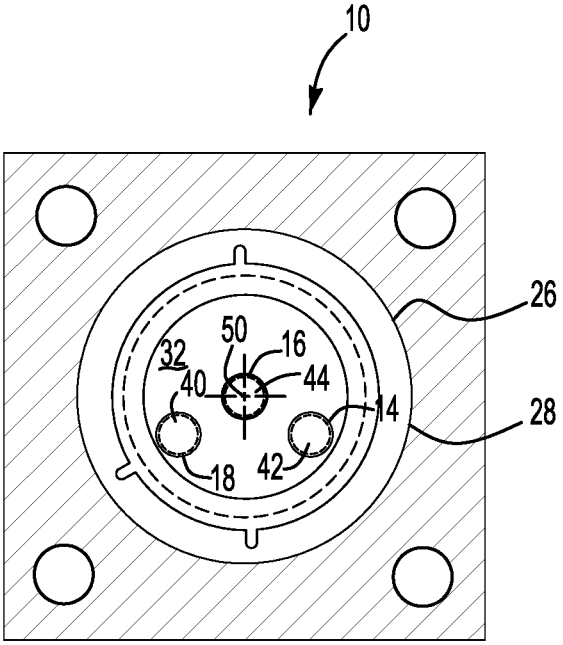
FIG. 6 is a view similar to FIG. 5, but illustrating the indexing plate in a second indexing position.

With reference now to FIG. 6, the orifice plate 28 is rotated to a second indexing position which, as shown, is approximately 120 degrees from the position shown in FIG. 5. In this position, the throughbores 40 and 44 through the orifice plate 28 are fluidly connected with the barrels 18 and 16, respectively. However, the throughbore 42 in the orifice plate 28 is not in fluid communication with any of the barrels 14-16. Consequently, upon ignition of the combustible charge 24 in the gun chamber 22, only two projectiles 20 contained in the barrels 16 and 18 will be simultaneously fired from the gun 10.

Figure 7:
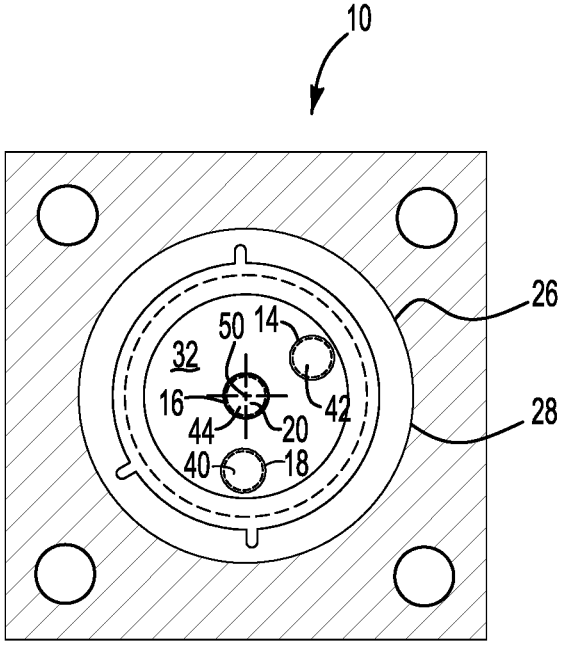
FIG. 7 is a view similar to FIGS. 5 and 6, but illustrating the indexing plate in a third indexing position.
Figure 8:
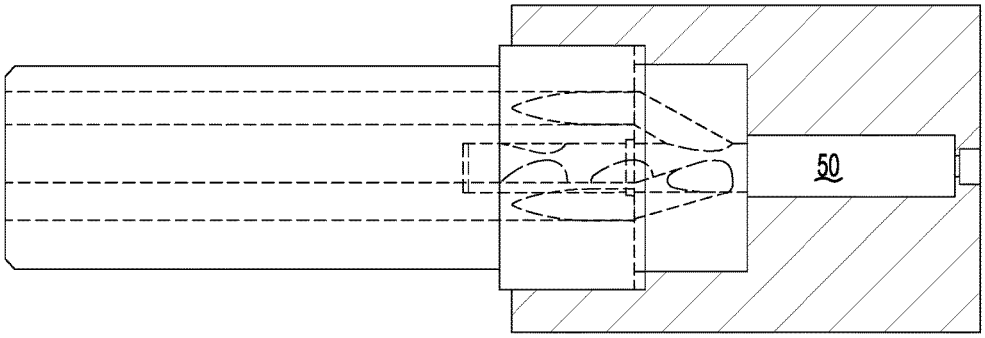
FIG. 8 is a longitudinal diagrammatic view illustrating a further embodiment of the present invention.

Finally, with reference to FIG. 7, the orifice plate 28 is rotated approximately 120 degrees from the position shown in FIG. 6 to its next indexing position. In this position, only the orifice 40, which is coaxial with the axis 30 of the orifice plate 28, is fluidly connected to the gun chamber 22. Consequently, upon pressurization of the gun chamber 22, only a single projectile 20 is fired from the barrel 16. Furthermore, since only a single projectile is fired, the muzzle exit velocity of the projectile 20 is much higher for the orifice plate position illustrated in FIG. 7.

With reference now to FIGS. 8-11, a further construction for the interface device 26 is shown in the form of an elongated tubular plunger 50 having an interior 52 and closed at its inner end 51 which is fluidly connected to the gun chamber 22. Consequently, upon pressurization of the gun chamber 22, the expanding gases flow into the interior 52 of the plunger 50 which varies the volume of the chamber.

Figure 9:
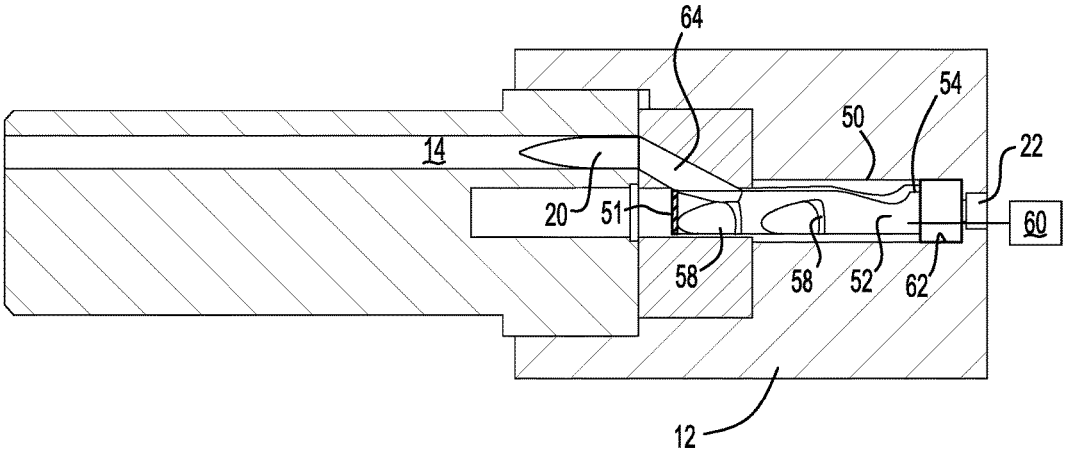
FIG. 9 is a diagrammatic view illustrating the plunger in a first longitudinal position.
Figure 10:
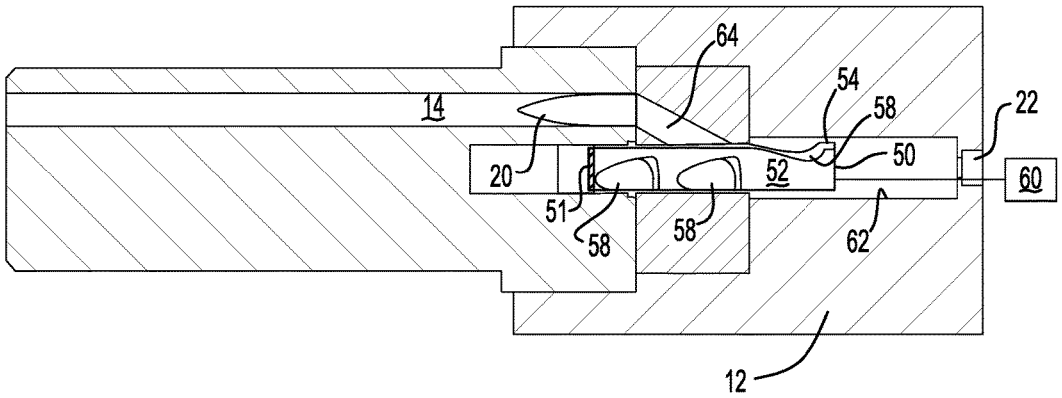
FIG. 10 is a view similar to FIG. 9, but illustrating the plunger in a second longitudinal position.
Figure 11:
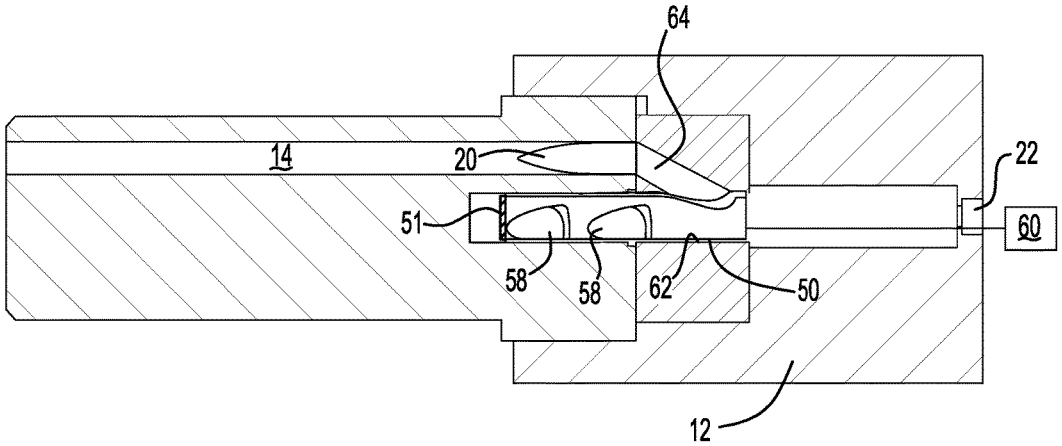
FIG. 11 is a view similar to FIGS. 9 and 10, but illustrating the plunger in a third longitudinal position.

Referring now to FIGS. 9-11, the plunger, which can translate axially, is mounted in a bore 62 in the gun body 12 while an actuator 60, which may be of any conventional construction, controls the axial position of the plunger 60. Three circumferentially spaced ports 58 are provided through the plunger 50 adjacent its innermost end. Similarly, two circumferentially spaced ports 56 are provided through the plunger 50 near the center of the plunger 50 while a single port 54 is provided through the plunger 50 adjacent its rear end. The three sets of ports 54, 56, and 58 are axially spaced from each other.

The gun body 12 includes three vents 64 which extend from each of the barrels 14-18 to the plunger bore 62. These three vents 64 intersect the plunger bore 62 at circumferentially spaced positions but at the same axial position along the plunger bore 62. Consequently, the axial displacement of the plunger 60 in the plunger bore 62 selectively connects the interior 52 of the plunger 60, and thus the gun chamber 22 to one, two, or all three of the barrels 14-18.

For example, with the plunger 50 in its retracted position as shown in FIG. 9, the three circumferentially spaced ports 58 are fluidly connected with all three vents 64 (only one shown) with one separate vent 64 fluidly connected to each of the three barrels 14-18. In this retracted position the plunger 50 additionally limits the amount of volume in the gun chamber 22, i.e. the total volume including the volume of the vents 64. This maintains higher pressures when all barrels are connected. Consequently, in this configuration, upon pressurization of the chamber 24 in the gun chamber 22, the expanding gases expand outwardly through all three ports 58 to all three barrels 14-18 to propel the projectiles 20 in each of the three barrels 14-18.

With reference now to FIG. 10, the actuator 60 has longitudinally shifted the plunger 50 in the bore 62 in the gun body 12. In this position, the two circumferentially spaced ports 56 formed through the plunger 50 register with only two of the vents 64 between two of the barrels 14 and 16 (not shown). Simultaneously, the plunger 60 closes the third vent 64 to the barrel 18. Furthermore, the closure of the third vent 64 to the barrel 18 effectively reduces the total volume of the gun chamber 22. However, simultaneously, the axial translation of the plunger 50 has increased the volume of the gun chamber 22 thereby preventing undesirable high pressures in the gun chamber 22.

With reference now to FIG. 11, when the actuator 60 longitudinally shifts the plunger 50 to its fully inserted position in the bore 62, the single port 54 is aligned with one vent 64 thus fluidly connecting the gun chamber 22 to the single barrel 14. Simultaneously, the plunger 50 effectively closes off the other vent openings 64 extending to the other barrels 16 and 18 and thus effectively reducing the volume of the gun chamber 22 by the volume of one vent 64. However, as before, the axial translation of the plunger 52 increases the gun chamber 22 volume thereby reducing the peak pressure. Consequently, with the plunger 50 in the position shown in FIG. 11, only a single projectile 20 is fired through the barrel 14 upon ignition of the combustible charge 24 in the gun chamber 22.

From the foregoing, it can be seen that the present invention provides a volley gun capable of selectively firing one or more projectiles simultaneously. Furthermore, the volume of the gun chamber may be effectively changed thus modifying the muzzle velocity of the fired projectile 20 and the peak pressure in the gun chamber 52.

Having described my invention, however, many modifications thereto will become apparent to those skilled in the art to which it pertains without deviation from the spirit of the invention as defined by the scope of the appended claims.

I claim:

1. A gun comprising:

at least three barrels, each barrel adapted to receive at least one projectile, a gun body, a gun chamber formed in said gun body and adapted to receive a propelling charge, an interface which selectively connects said gun chamber with one or more of said barrels, wherein said interface comprises a valve disposed between said gun chamber and said barrels wherein said valve is mounted in said gun body wherein said valve comprises a valve member rotatable about an axis parallel to an axis of said barrels, said valve member having at least two axially extending openings which selectively connect said gun chamber with one or more barrels depending on the rotational position of said valve member, wherein said interface comprises a tubular plunger open at one end to said gun chamber and axially slidably movable in said gun body, said plunger having a plurality of openings which selectively connect an interior of said plunger to one or more barrels through passageways in said gun body depending on the axial position of said plunger.

2. The gun as defined in claim 1 wherein said plunger is movable in a direction parallel to an axis of said barrels.

3. The gun as defined in claim 1 wherein as said plunger moves axially, said plunger changes an effective volume of said gun chamber.

4. The gun as defined in claim 1 wherein said propelling charge comprises an ignitable explosive charge.

5. The gun as defined in claim 1 wherein said plunger is closed at its other end.

* * * * *